United States Patent [19]

Yanik et al.

[11] 4,060,340

[45] Nov. 29, 1977

[54] AIR COMPRESSOR WITH INLET DIVERSION VALVE

[75] Inventors: LeRoy Yanik; Dario R. Gross, both of Owosso, Mich.

[73] Assignee: Midland-Ross Corporation, Cleveland, Ohio

[21] Appl. No.: 644,116

[22] Filed: Dec. 24, 1975

[51] Int. Cl.[2] ..... F04B 49/00; F16B 15/18

[52] U.S. Cl. ..... 417/28; 417/298; 417/302; 137/625.27; 137/625.66

[58] Field of Search ..... 417/26, 28, 298, 302, 417/306

[56] References Cited

U.S. PATENT DOCUMENTS

| | | | |
|---|---|---|---|
| 2,047,489 | 7/1936 | Pfiefer | 417/298 |
| 2,328,902 | 9/1943 | Grove | 137/625.27 |
| 2,728,517 | 12/1955 | Shumaker | 417/306 |
| 2,766,766 | 10/1956 | White | 417/298 |
| 2,804,878 | 9/1957 | Fishwood et al. | 417/298 |
| 3,054,552 | 9/1962 | Doubleday et al. | 417/306 |
| 3,057,540 | 10/1962 | Schumaker | 417/302 |
| 3,270,675 | 9/1966 | Ajam | 417/306 |
| 3,389,720 | 6/1968 | Bradenberg | 137/625.66 |
| 3,768,518 | 10/1973 | Roth | 137/625.66 |

FOREIGN PATENT DOCUMENTS

| | | | |
|---|---|---|---|
| 944,823 | 7/1960 | United Kingdom | 137/625.27 |

*Primary Examiner*—William L. Freeh
*Attorney, Agent, or Firm*—H. Duane Switzer

[57] ABSTRACT

An air compressor has an inlet supplied with pressurized air, and is operable in a pumping mode and in a non-pumping unloaded mode. Unloader means is provided for placing the compressor in its unloaded mode. When the compressor is placed in its unloaded mode, diversion valve means operates for blocking communication of the inlet with the pressurized air supply and establishing communication of the inlet with atmosphere.

5 Claims, 6 Drawing Figures

AIR COMPRESSOR WITH INLET DIVERSION VALVE

BACKGROUND OF THE INVENTION

This application pertains to the art of air compressors and, more particularly, to air compressors which are supplied with pressurized air. The invention relates specifically to a diversion valve for blocking communication of the pressurized air supply with the compressor when the compressor is unloaded. It will be recognized that the improved diversion valve of the present application may be used in other environments for other purposes.

For various reasons, air compressors are frequently supplied with pressurized air. For example, air compressors are commonly mounted on vehicles having fuel burning engines for supplying compressed air to the vehicle air brakes and other pneumatically operated devices. In arrangements of this type, the compressor inlet is often connected to the engine air manifold to provide a source of clean filtered air for the compressor. On engines which are supercharged or turbocharged, the air supplied to the compressor from the engine air manifold is superatomospheric and may be as high as 25 psig. Therefore, when the compressor is unloaded, it is still working against this superatmospheric pressure, and this causes excessive wear on the wrist pin and main bearing.

It would be desirable to have an arrangement for relieving the compressor of the superatmospheric pressure when the compressor is unloaded in order to minimize wear on the wrist pin and main bearing.

SUMMARY OF THE INVENTION

A compressor of the type which includes an inlet valve communicating with a pressurized gas source, and a governor and unloader for unloading the compressor by holding the inlet valve open, has diversion valve means between the inlet valve and the pressurized gas source for blocking communication of the pressurized gas source with the inlet valve when the governor and unloader operate to hold the inlet valve open.

In a preferred arrangement, the diversion valve means moves to a blocking position for blocking communication of the pressurized gas source with the inlet valve when the compressor is unloaded, and the diversion valve means includes vent means for opening the inlet valve to communication with atmosphere in the blocking position of the diversion valve means.

The diversion valve means may be connected for movement to its blocking position by pressure signals sent from the compressor governor.

The diversion valve means of the present application includes a valve body having a gas source port communicating with a pressurized gas source and a supply port communicating with the compressor inlet valve. A movable valve member in the valve body is movable between a first position establishing communication between the gas source port and the supply port, and a second position blocking communication between the gas source port and the supply port. Yieldable biasing means is provided for normally biasing the movable valve member to its first position. A vent port is preferably provided in the valve body communicating with atmosphere. In its first position, the valve member closes the vent port and in its second position establishes communication between the vent port and supply port.

The valve body of the diversion valve means includes a variable volume chamber receiving an extension portion on the movable valve member in sliding sealing engagement therewith. A signal port or control port from the compressor governor communicates with the variable volume chamber for acting against the extension portion of the movable valve member and moving such member to its second position against the force of the yieldable biasing means.

The movable valve member may take many forms, and in one arrangement comprises a one-piece elastomeric valve member. In another arrangement, the movable valve member comprises a two-piece metal valve member.

The gas source port and signal port from the compressor governor are preferably located opposite one another on the valve body, while the vent port and supply port to the compressor open laterally of the valve body intermediate the gas source supply port and governor signal port.

The movable valve member has a main body portion opposite from its extension portion for engaging a seat surface adjacent the vent port in the first position of the valve member, and for engaging a seat surface adjacent the gas source port in its second position.

It is a principal object of the present invention to provide an improved control arrangement for air compressors to minimize wear thereon.

It is a further object of the invention to arrange a compressor which is supplied with pressurized air so that the compressor is completely relieved of pressure when it is unloaded.

It is also an object of the present invention to arrange a compressor for blocking a source of pressurized air from communicating with the compressor inlet while simultaneously opening the compressor inlet to atmosphere.

It is an additional object of the present invention to provide an improved diversion valve.

DESCRIPTION OF PREFERRED EMBODIMENTS

Figure 1:
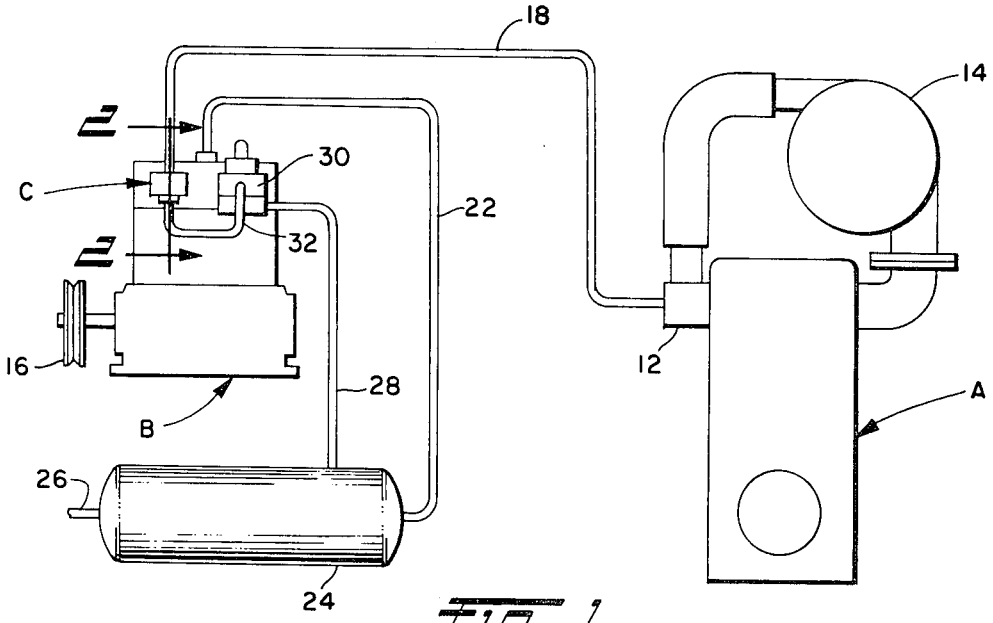
FIG. 1 is a schematic illustration of a compressor system having the improvements of the present invention incorporated therein.

With reference to the drawing, FIG. 1 shows a fuel burning engine A, such as a diesel engine, having an inlet air manifold 12 supplied with air at superatmospheric pressure by a supercharger or turbocharger 14 in a known manner. The air pressure in manifold 12 may be as high as 25 psig, and the air is normally clean because it is filtered before passing through supercharger 14 to manifold 12.

An air compressor B has a pulley 16 driven by a belt from engine A in a known manner, and air supply conduit 18 is connected between manifold 12 and the inlet of compressor B through an inlet diversion valve C constructed in accordance with the present invention. A discharge conduit 22 extends from the compressor outlet to an air reservoir 24 having an outlet conduit 26 through which high pressure air produced by the air compressor B is supplied to various pneumatically operated devices. An air supply conduit 28 extends between reservoir 24 and a governor 30 which may be of any suitable type, including the type disclosed in U.S. Pat. No. 3,670,756 issued June 20, 1972, to Schultz, the disclosure of which is hereby incorporated herein by reference. Governor 30 has a signal or control conduit 32 communicating with inlet diversion valve C, and another control or signal conduit extends from governor 30 to an unloader on compressor B.

In normal systems of the type described, there is no inlet diversion valve C so that air supply conduit 18 is connected directly to the inlet of compressor B, and there is no signal conduit 32. In such arrangements, compressor B operates for pressurizing reservoir 24 until a predetermined pressure has been built up therein. When the predetermined pressire is reached, it acts through conduit 28 on governor 30 for moving a piston or diaphragm and supplying that pressure to an unloader for holding the inlet valve of compressor B open. When compressor B is unloaded in this manner, the air supply pressure from conduit 18, which is common to the engine manifold 12, continuously acts upon the piston in the compressor cylinder, and this causes excessive wear on the compressor wrist pin and main bearing. In accordance with the present application, the addition of inlet diversion valve C and signal conduit 32 operates diversion valve C for blocking communication of supply conduit 18 with the compressor inlet, while venting the compressor inlet to atmosphere.

Compressor B may take many different forms, and may include more than one cylinder, and may be of the multi-stage type. One somewhat diagrammatic illustration of a typical air compressor is shown in FIG. 2 simply for illustrating the operation of the improved diversion valve of the present invention.

Figure 2:
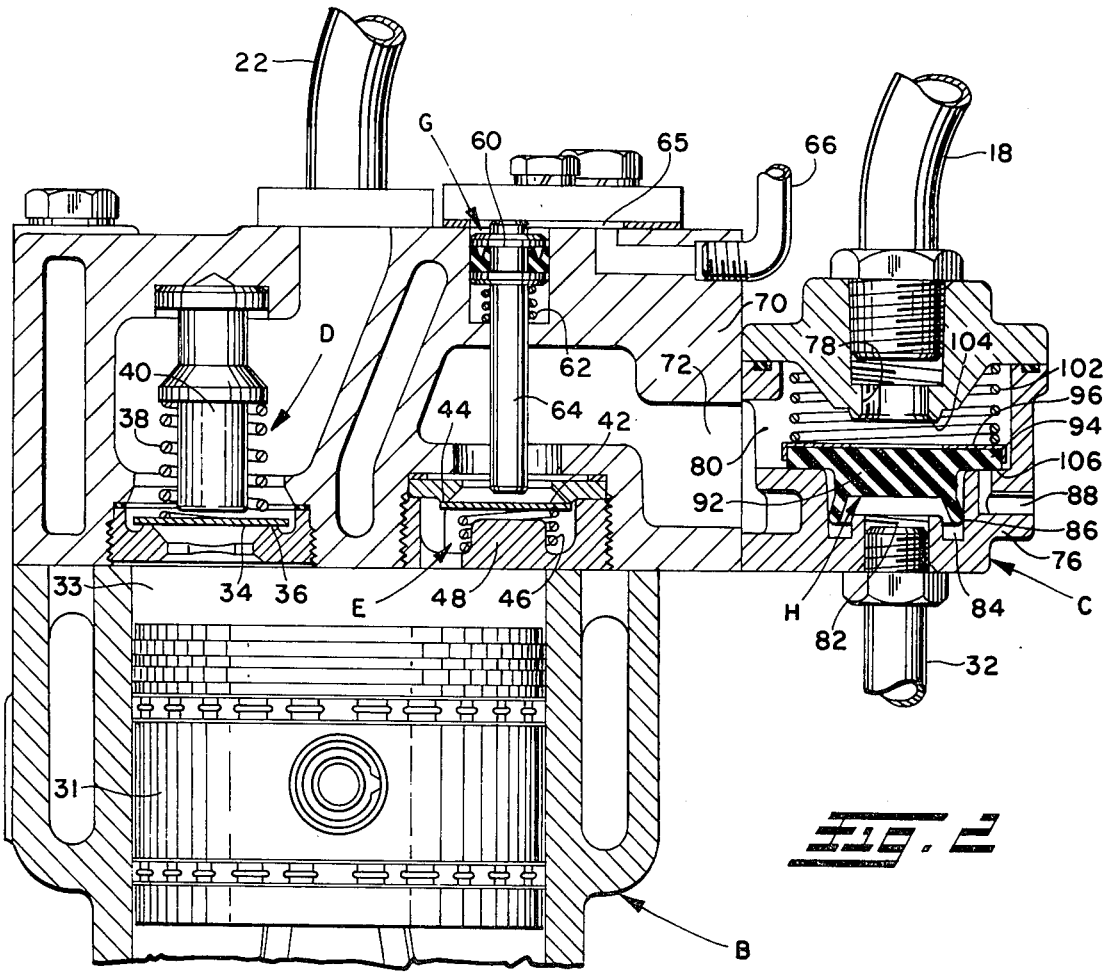
FIG. 2 is a cross-sectional elevational view taken generally on line 2—2 of FIG. 1.

With reference to FIG. 2, compressor B includes a piston 31 reciprocating in a cylinder 33 having an exhaust valve D and an inlet valve E. Exhaust valve D includes a movable valve disc 34 biased against a seat 36 by a coil spring 38 surrounding valve stop 40. Inlet valve E includes a movable valve disc 42 biased against a seat 44 by a coil spring 46 surrounding valve stop 48. On the downward intake stroke of piston 31, inlet valve E opens so that air is drawn into cylinder 33. On the upward compression stroke of piston 31, discharge valve D is opened for supplying air through conduit 22 to reservoir 24.

Compressor B includes an unloader G having an unloader piston 60 reciprocatingly positioned in a bore and normally biased upwardly in FIG. 2 by a coil spring 62. Unloader piston 60 includes an elongated projection 64 aligned with valve disc 42. A passage 65 communicates with the bore in which unloader piston 60 is received, and is connected by a conduit 66 with governor 30 of FIG. 1. Conduit 66 is a control or signal conduit corresponding to signal conduit 32 connected with inlet diversion valve C.

Compressor B includes an intake flange 70 having an inlet 72, and diversion valve C is suitably bolted to flange 70. Inlet diversion valve C includes a valve body 76 having a movable valve member H movably mounted therein. Valve body 76 has a gas source supply port 78, which may also be termed an inlet port, connected by conduit 18 with a pressurized gas source at superatmospheric pressure. Valve body 76 has an outlet port 80, which also defines a supply port, aligned with compressor inlet port 72 for supplying air or gas at superatmospheric pressure to inlet valve E. A control or signal port 82 in valve body 76 communicates with a variable volume chamber defined by a cylindrical bore 84 having an extension portion 86 of movable valve member H received therein in sliding sealing engagement with the wall thereof. In the arrangement shown, valve member H is a one-piece body of elastomeric material and extension portion 86 comprises an outwardly flared conical lip engaging the wall of the bore defining variable volume chamber 84. Signal port 82 is connected by signal conduit 32 with governor 30. A vent port 88 in valve body 76 communicates with atmosphere and with the interior of the valve body.

Valve member H includes a main body portion 92 opposite from extension portion 86 thereof and is generally circular in a top plan view. Main body portion 92 includes an outwardly extending flange 94 which may have a top member 96 positioned thereon and against which a coil spring 102 acts for normally biasing valve member H downwardly in FIG. 2. Pressurized gas source port or inlet port 78 has a seat 104. The surface 106 through which vent port 88 enters the interior of valve body 76 may also be considered a valve seat which is engageable by the undersurface of valve member flange 94.

Figure 4:
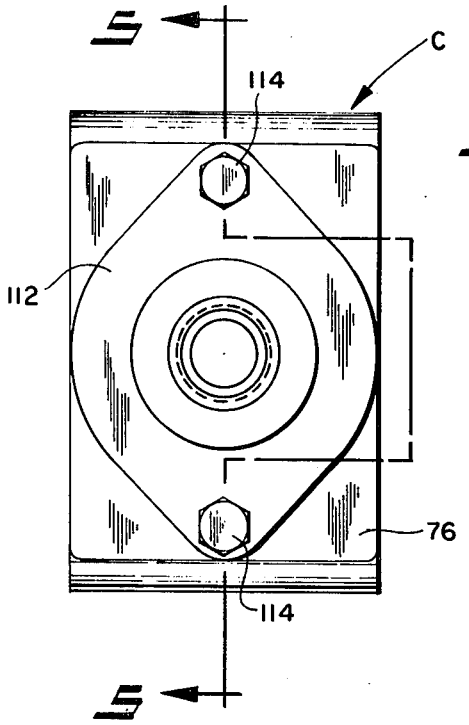
FIG. 4 is a top plan view taken generally on line 4—4 of FIG. 3.
Figure 5:
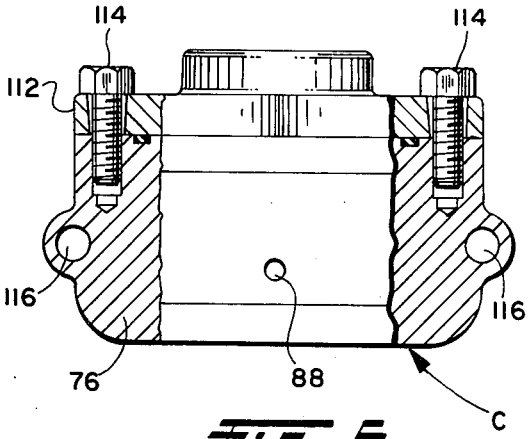
FIG. 5 is a partial cross-sectional elevational view taken generally on line 5—5 of FIG. 4.

FIGS. 4 and 5 show valve body 76 of diversion valve C as being of two-piece construction including a cover member 112 having inlet or pressurized gas supply port 78 therein, and being bolted to the remainder of the valve body as by bolts 114. Holes 116 of FIG. 5 receive bolts which extend into tapped bores in compressor intake flange 70 for securely clamping diversion valve C to the compressor. Thus, diversion valve C has mounting means integral therewith for mounting same directly to compressor B with ports 72 and 80 in direct communication as shown in FIG. 2. Obviously, suitable gasketing may be provided between the compressor flange and the diversion valve.

Coil spring 102 defines a yieldable biasing means which normally biases movable valve member H to a first position shown in FIG. 2 wherein the undersurface of valve member flange 94 engages seat 106 to close or block vent port 88, while establishing communication between inlet or pressurized gas supply port 78 and outlet or compressor supply port 80. During the pumping operation of compressor B, the parts remain as shown in FIG. 2 with inlet valve E and exhaust valve D alternately opening and closing for supplying air to reservoir 24 of FIG. 1. Once reservoir 24 is pressurized to a predetermined pressure, that pressure acts through conduit 28 upon governor 30 for operating such governor to send a pressure control signal through signal conduits 32 and 66 to diversion valve C and unloader G. The pressure signal sent through signal conduit 66 to unloader G causes unloader piston 60 to move downwardly in FIG. 2 against the force of spring 62 so that projection 64 engages and moves valve disc 42 away from seat 44. Substantially simultaneously, the pressure signal sent through signal conduit 32 enters valve body 76 through governor port 82 and acts within variable volume chamber 84 upon extension portion 86 of movable valve member H for shifting such movable valve member to the position shown in FIG. 3 wherein the upper surface of valve main body portion 92 engages seat 104 for blocking communication between inlet port 78 and outlet port 80, while establishing communication between outlet port 80 and vent port 88 around the periphery of valve main body portion 92 beneath flange 94. Therefore, the source of pressurized gas or air is blocked against communication with the compressor inlet and the compressor inlet valve, while the compressor inlet and compressor inlet valve are in continuous communication with atmosphere through vent port 88. Piston 31 is now simply reciprocating within cylinder 33 under substantially no load so that wear on the compressor main bearing and wrist pin is substantially minimized. Once the pressure within reservoir 24 has dropped back down to a predetermined level, the lower pressure is sensed by governor 30 which then operates to exhaust the pressure in signal conduits 32 and 66 so that unloader piston 60 and movable valve member H move back to the positions shown in FIG. 2 under spring force and compressor B is again in a pumping mode for supplying pressure to reservoir 24. When governor 30 operates, it places compressor B in a non-pumping unloaded mode while simultaneously blocking communication between the compressor inlet and the pressurized supply source and establishing communication between the compressor inlet and atmosphere.

Figure 3:
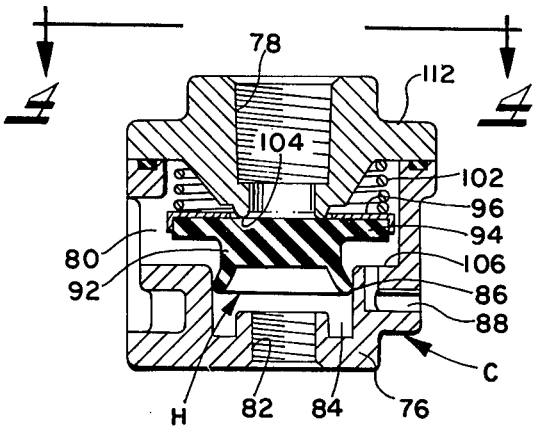
FIG. 3 is a cross-sectional elevational view of the diversion valve of FIG. 2, and showing the valve in a different operating mode.
Figure 6:
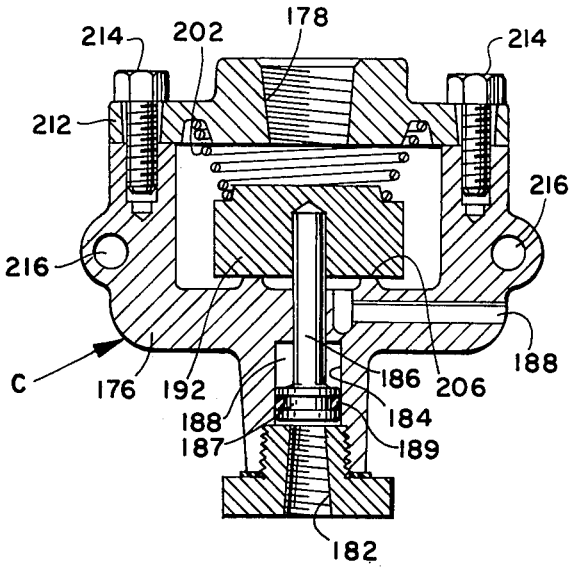
FIG. 6 is a cross-sectional elevational view of another form of diversion valve constructed in accordance with the present invention.

FIG. 6 shows another arrangement for a diversion valve C wherein a valve body 176 has an inlet port 178 corresponding to port 78 of FIGS. 2 and 3. Such port may be in a cover member 212 secured to the remaining portion of the valve body by bolts 214. Holes 216 are provided for bolting the valve to the manifold of a compressor. The outlet port or supply port from the valve of FIG. 6 to the compressor inlet is not shown because it lies in the plane of the paper. However, it generally corresponds to outlet port 80 of FIGS. 2 and 3. A vent port 188 in valve body 176 corresponds with vent port 88 of FIGS. 2 and 3. A movable valve member has a main body portion 192 of metal and is acted upon by a coil spring 202 for normally biasing same downwardly so that its undersurface engages a seat 206 surrounding vent port 188. An extension portion 186 comprises a separate metal stem member that slides freely into main body portion 192, and includes a stem head portion 187 having an O-ring 189 engaging the wall of a cylindrical bore 184 defining a variable volume chamber. Governor port 182 corresponds to governor port 82 of FIGS. 2 and 3, and communicates with variable volume chamber 184 below head 187. Operation of the valve of FIG. 6 is the same as described with respect to the valve of FIGS. 2 and 3. The flat upper surface of valve main body portion 192 engages the flat undersurface of cover member 212 around inlet port 178 when a pressure signal acts through governor port 182 on enlarged head 187 to block communication between the inlet port and the outlet port. When the governor operates to relieve the pressure in the variable volume chamber, coil spring 202 shifts the movable valve member back to the position shown in FIG. 6 so that the flat undersurface of metal main body portion 192 engages seat 206 for blocking vent port 188. The valve of FIG. 6 simply has metal-to-metal seating.

For purposes of definition and description in the claims, port 78 may be termed a gas source port or an inlet port for valve body 176. Port 80 may be termed a supply port for the inlet of compressor B or an outlet port for valve body 76. Port 82 may be termed a governor port, a control port or a signal port. Ports 78 and 82 are preferably located generally opposite from one another in the valve body, while ports 80 and 88 open laterally of the valve body intermediate ports 78 and 82. The improved inlet diversion valve of the present application operates substantially simultaneously with the unloader for blocking communication between the compressor inlet and the source of pressurized air, while establishing communication between the compressor inlet and atmosphere.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

We claim:

1. A compressor having an inlet port communicating with a pressurized gas source, a compressor inlet valve communicating with said inlet port, a governor and unloader for unloading said compressor by maintaining said inlet valve open, diversion valve means between said inlet port and the pressurized gas source for blocking communication of the pressurized gas source with said inlet valve through said inlet port when said governor and unloader operate to maintain said inlet valve open, said diversion valve means including a valve body having generally oppositely located gas source and governor ports respectively communicating with said pressurized gas source and with said governor, said valve body having supply and vent ports located intermediate said gas source and governor ports and respectively communicating with said inlet port and with atmosphere, said diversion valve means including mounting means for mounting same directly to said compressor with said supply port in direct communication with said inlet port, a movable valve member in said valve body and including an enlarged main body portion and a smaller extension portion, said valve member being movable between a first position wherein said main body portion closes said vent port while establishing communication directly therepast between said gas source and supply ports and a second position wherein said main body portion closes said gas source port while establishing communication directly therepast between said supply and vent ports, said movable valve member in both said positions thereof maintaining said governor port isolated against communication with the other of said ports, yieldable biasing means acting directly on said main body portion of said valve member for normally biasing said valve member to said first position, said valve body having a cylindrical bore defining a variable volume chamber communicating with said governor port and including a variable volume chamber wall, said extension portion of said valve member being positioned in said chamber in sliding sealing engagement with said wall for movement of said valve member to said second position by fluid pressure supplied to said variable volume chamber through said governor port.

2. The compressor of claim 1 wherein said valve body has a first seat surface adjacent said vent port and a second seat surface adjacent said gas source port, said vent port being in communication with the interior of said valve body in outwardly spaced relationship to said extension portion of said valve member, said main body portion of said movable valve member having oppositely facing upper and under surfaces, said upper surface being in engagement with said first seat surface in said first position of said valve member and said under surface outwardly of said extension portion of said valve member being in engagement with said second seat surface in said second position of said valve member.

3. The valve of claim 1 wherein said movable valve member comprises a one-piece elastomeric valve member.

4. The valve of claim 1 wherein said movable valve member comprises a two-piece metal valve member including one piece defining said extension portion secured to a second piece defining said main body portion.

5. The valve of claim 1 wherein said valve body is of two-piece construction including a cover portion and a remaining portion, said inlet port being in said cover portion and the other of said ports and said variable volume chamber being in said remaining portion.

* * * * *